US007540484B2

(12) United States Patent
Mandel et al.

(10) Patent No.: US 7,540,484 B2
(45) Date of Patent: Jun. 2, 2009

(54) SYSTEM OF OPPOSING ALTERNATE HIGHER SPEED SHEET FEEDING FROM THE SAME SHEET STACK

(75) Inventors: Barry P. Mandel, Fairport, NY (US); Robert A. Clark, Williamson, NY (US); Kathleen A. Feinberg, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 511 days.

(21) Appl. No.: 11/049,190

(22) Filed: Feb. 2, 2005

(65) Prior Publication Data

US 2006/0170144 A1 Aug. 3, 2006

(51) Int. Cl.
*B65H 5/26* (2006.01)

(52) U.S. Cl. ..... 271/9.04; 271/10.11; 271/171

(58) Field of Classification Search ..... 271/171, 271/9.04, 10.01, 10.09, 10.11; 399/393, 399/388

See application file for complete search history.

(56) References Cited

U.S. PATENT DOCUMENTS 3,335,859 A 8/1967 Borchert et al.
4,451,028 A 5/1984 Holmes et al.
4,469,319 A * 9/1984 Robb et al. ..... 271/3.05
4,540,166 A * 9/1985 Massengeil et al. ..... 271/3.01
4,579,446 A 4/1986 Fujimo et al.
4,587,532 A 5/1986 Asano
5,208,640 A 5/1993 Horie et al.
5,221,951 A * 6/1993 Sakamoto ..... 399/393
5,327,207 A * 7/1994 Otake et al. ..... 399/364
5,568,246 A 10/1996 Keller et al.
5,596,416 A 1/1997 Barry et al.
5,778,783 A 7/1998 Compera et al.

(Continued)

FOREIGN PATENT DOCUMENTS

GB 186 463 A 10/1922

(Continued)

OTHER PUBLICATIONS

Xerox Disclosure Journal, vol. 11, No. 1, Jan./Feb. 1986 by M. C. Hogenes "Extendible Baffles".*

(Continued)

*Primary Examiner*—Patrick H Mackey
*Assistant Examiner*—Gerald W McClain
(74) *Attorney, Agent, or Firm*—Fay Sharpe LLP

(57) ABSTRACT

In a printing system in which the print media sheets are alternately fed from the same stack in the same tray by two sheet feeders at opposite sides into different sheet paths, at least one of the sheet feeders is repositionable towards and away from the other for feeding different size sheets, and the connecting sheet path is repositionable with the repositioning of the sheet feeder. The repositioning of the sheet feeder and its associated sheet path may be automatic in coordination with the normal resetting of a tray stack edge guide with the loading of different size sheets into the tray. The enhanced rate sheet feeding may be for a dual print engine printing system and/or selectably common or reversed sheet facing. Alternating coordinated lifting of a nudger roll of one sheet feeder with operation of the opposing sheet feeder, and retard nips spaced from the stack, may be provided.

5 Claims, 10 Drawing Sheets

U.S. PATENT DOCUMENTS

| | | | | |
|---|---|---|---|---|
| 5,941,518 | A | 8/1999 | Sokac et al. | |
| 5,954,325 | A * | 9/1999 | Nagao | 271/3.05 |
| 6,125,248 | A | 9/2000 | Moser | |
| 6,182,961 | B1 | 2/2001 | Wenth, Jr. | |
| 6,264,188 | B1 | 7/2001 | Taylor et al. | |
| 6,398,207 | B1 | 6/2002 | Taylor et al. | |
| 6,398,208 | B1 | 6/2002 | Yang et al. | |
| 6,582,039 | B2 * | 6/2003 | Johnson et al. | 347/3 |
| 6,597,889 | B2 * | 7/2003 | Johnson et al. | 399/393 |
| 6,608,988 | B2 | 8/2003 | Conrow | |
| 6,682,237 | B2 * | 1/2004 | Cocklin et al. | 400/624 |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Biegelsen et al. | |
| 2004/0150158 | A1 | 8/2004 | Biegelsen et al. | |
| 2004/0216002 | A1 | 10/2004 | Bobrow et al. | |
| 2004/0225391 | A1 | 11/2004 | Bobrow et al. | |
| 2004/0225394 | A1 | 11/2004 | Bobrow et al. | |
| 2004/0247353 | A1 * | 12/2004 | Antinora | 399/382 |

FOREIGN PATENT DOCUMENTS

| | | | |
|---|---|---|---|
| JP | 59 198233 | A | 11/1984 |

OTHER PUBLICATIONS

U.S. Appl. No. 10/761,522, filed Jan. 21, 2004 "High Print Rate Merging and Finishing System for Parallel Printing," Mandel et al.

*Xerox Disclosure Journal*, vol. 16, No. 6, Nov./Dec. 1991, pp. 381-383 by Morgan "Integration of Black Only and Color Printers".

*Xerox Disclosure Journal*, vol. 11, No. 1, Jan./Feb. 1986 by M. C. Hogenes "Extendible Baffles".

* cited by examiner

SYSTEM OF OPPOSING ALTERNATE HIGHER SPEED SHEET FEEDING FROM THE SAME SHEET STACK

Cross-reference is made to copending and commonly owned U.S. application Ser. No. 10/455,656 filed Jun. 5, 2003 by Terrance J. Antinora, entitled "Printer With Integral Automatic Pre-Printed Sheets Insertion System," published Dec. 9, 2004 as Publication No. 20040247353Also cross-referenced is copending commonly owned U.S. application Ser. No. 10/761,522 filed Jan. 21, 2004 and entitled "High Print Rate Merging and Finishing System for Parallel Printing" by Robert Lofthus, Barry Mandel, Steve Moore and Martin Krucinski, projected to be published Dec. 6, 2005 as Publication No. 10/761522.

Disclosed in the embodiments herein is an improved system for feeding sheets from the same stack at a faster rate and/or with lower cost sheet separator feeders by feeding individual sheets alternately from opposite sides of the same sheet stack even for different sizes of sheets, and other disclosed advantages.

To feed sheets from the same stack, and keep up with the full printing rate of the associated higher speed printer, often requires a more sophisticated and expensive sheet separator/feeder, such as the pneumatic type cited by way of background herein, which can cost more than twice as much as more common, and much less costly, friction retard feeders, and may also require additional space, ducting, power consumption and noise shielding for their pneumatic systems. Even active or semi-active roll friction feeders, even with air stack fluffing assistance, have practical limitations in extending their utility for highly reliable (low sheet misfeed and sheet double-feed rates) high speed sheet separation and feeding for such higher printing productivity rates. (E.g., feeding from the same stack with a single low cost friction retard type sheet feeder operating at more than approximately 110 pages per minute can increase sheet feeding reliability problems such as miss-feeds multiple feeds, skipped printing pitches and/or printer jam clearance stoppages, and thus reduced customer satisfaction, although this is not to suggest any particular speed limitation on the utility or application of the disclosed systems. Even slower printing systems can benefit in sheet feeding reliability by effectively approximately doubling the acquisition time available for sheet separation and take-away for each sheet feeder. Longer top sheet acquisition times can provide for more reliable sheet separations.

For faster printing rates, the individual print media sheets must be fed at a correspondingly faster rate at the proper times. Reducing the time required for reliable separation of an individual print media sheet from the top of a stack of print media sheets and for feeding those separated sheets from the stack into an output sheet path at the desired times may be referred to as reducing "sheet acquisition times." Reduced sheet acquisition times tends to reduce reliable separating and feeding of the individual print media sheets from the stack, and thus often requires more complex and costly sheet feeders. Sheet separations can be difficult, especially for coated papers or transparencies. For paper print media it is relatively common, for example for cut stacks of paper sheets to have what are called "edge weld" fiber adhesions to one another at the sheet edges.

With ganged or other integrated plural print engine printing systems, such as those disclosed or referenced herein, even lower speed print engines may require higher sheet feeding rates for feeding sheets to the integrated plural print engine system fast enough for full productivity printing with plural such print engines printing simultaneously. That is, printing systems for increasing printing rates by combining plural print engines, which can print alternating or opposing pages of a print job, as in the exemplary patents thereon cited herein, can create additional difficulties.

Those additional difficulties with integrated plural print engines include an increased need to print print-jobs on the same consistent print media, and thus increased need to avoid operator error in loading inconsistent print media into different sheet feed trays, especially where those different trays may be feeding print media to different print engines for the same print job, especially the facing pages of a book. Sheet feeding from different sheet stacks for the same print job can introduce various other problems, and is desirably avoided by the system disclosed herein.

In particular, for either single or plural print engine printers, feeding sheets from the same sheet stack for the same print job, that is, feeding sheets from the same sheet tray, bin or cassette rather than from more than one different stacks in different trays, bins or cassettes (those terms may be used interchangeably herein), can reduce the chances of feeding different or inconsistently printing print media, where that is not desired. For example, where a printer operator may have accidentally loaded different types or batches of print media into one of the trays designated for use for a print job having a different sheet color, weight, size, stiffness, humidity, etc. Also, it is common for cost reasons for xerographic printers to have only one so-called "hi-cap" feeder module, with a single elevator tray for holding multiple reams of sheets.

Some of the disclosed features of some of the disclosed embodiments can include, for example, lower cost and/or more reliable sheet feeding by enabling sheet feeding with lower cost sheet feeders that can desirably individually have longer (slower) sheet separation and total sheet acquisition times yet feed consistent print media from the same sheet feed stack in the same sheet feed tray to the same or different print engines at the printing rate of the overall printing system.

In the disclosed embodiments two separate sheet feeders can feed sheets alternately from the same sheet stack without interfering with one another, even though their respective sheet feeds can be slower and largely or substantially overlapping in time. However, a commercially practical such system should desirably be able to do so even for different sheet stack dimensions, since different size sheets may be loaded into the same sheet feeding tray for different print jobs, or for different size sheets used in different countries.

Variously disclosed in these embodiments is a system and method to provide the above or other advantages even though the subject sheet tray is adjustable to accommodate stacks of various different sheet sizes. As disclosed, a repositioning movement of one of the two opposing sheet feeders may be provided when paper of a different size is loading into the sheet tray. As disclosed, this system addition can be provided with little increased cost or complexity, such as by being directly tied to the normal operator repositioning movement of a conventional stack side or edge guide, or stack end guide, which, as is well known, is already done by the operator whenever different size sheets are loaded into a sheet feeding tray. The tray itself does not have to move. A coordinated repositionable sheet path from the repositionable feeder(s) is also disclosed.

An additional optional disclosed feature is that feeding out sheets from a stack in opposite directions can allow a selection of optionally feeding the sheets into oppositely entered inversion or non-inversion paths, such as one or more pre-transfer natural or other sheet inversion paths versus natural non-inversion paths. This can provide additional utility. For example, allowing either face up loading or face down loading into the tray of orientation critical sheets such as letterhead or other pre-printed print media sheets, hole punched or tab stock print media, etc. Such sheets can be fed correctly to be printed without manual or mechanical inversion by selecting feeding from one side or the other of their stack into one such path or the other with two different sheet feed paths from the same tray.

However, in other printing applications, such as dual print engines printing the same print job, it may be desirable that the sheets fed from opposite sides of the stack are printed on the same face of the sheets being fed, for printing uniformity, even though the sheets fed from opposite sides of the stack are initially moving in opposite directions, one of which may need to reverse its movement direction, and these respective alternate sheets must at least initially pass through two different sheet transport paths.

Although particularly attractive for the disclosed or other integrated plural print engine printing systems, it will be apparent to those skilled in this art that the disclosed nearly doubled sheet feed head acquisition time allowed for the same output sheet feeding rate from a single sheet tray, and other advantages, may also be highly desirable for various single print engine printing systems.

The following U.S. patents have been noted by way of background as to the subject embodiments: In particular, the single stack dual sheet feeder systems of Johnson, et al (Hewlett-Packard Development Company, L.P.) U.S. Pat. No. 6,597,889 B2 issued Jul. 22, 2003, and published Jan. 30, 2003 as Pub. No. 2003/0021619 A1. Also, Otake, et al, (Sanyo Electric Co., Ltd.) U.S. Pat. No. 5,327,207 issued Jul. 5, 1994; Sakamoto (Sanyo Electric Co., Ltd.); U.S. Pat. No. 5,221,951 issued Jun. 22, 1993; Holmes et al (Xerox Corp.); U.S. Pat. No. 4,451,028 issued May 29, 1984; Gerhard Erich Borchert et al (Bundesdruckeriei Berlin); U.S. Pat. No. 3,335,859 issued Aug. 15, 1967; and Compera et al (Heidelberger Druckmaschinen); and U.S. Pat. No. 5,778,783 issued Jul. 14, 1998.

By way of further background and incorporation by reference as to one optional disclosed feature or alternatives thereto, the Xerox Disclosure Journal publication Vol. 11, No. 1, January/February 1986, by M. C. Hogenes entitled "Extendible Baffles," discloses an automatic telescoping (extendable and retractable length) sheet path baffle automatically changing in baffle path length with movement of a repositionable stack edge guide for the re-stacking of different size sheets. Also, the automatically telescoping baffles providing a variable length sheet transport path (varying in stack height) from a sheet feeder shown in Xerox Corp. U.S. Pat. No. 5,941,518 issued Aug. 24, 1999 to Sokac, et al.

Also noted as of background interest and for incorporation by reference (as appropriate) as to plural print engine printing systems are some examples of what have been variously called "tandem engine" printers, "cluster printing," "output merger" systems, etc. For example, Xerox Corp. U.S. Pat. No. 5,568,246 issued Oct. 22, 1996 by Paul D. Keller, et al; U.S. Pat. No. 6,608,988 B2 issued Aug. 19, 2003 by Brian Conrow and previously USPTO published on Apr. 24, 2003 as Pub. No. 2003/0077095 A1 entitled "Constant Inverter Speed Timing Method and Apparatus for Duplex Sheets in A Tandem Printer;" Canon Corp. U.S. Pat. No. 4,587,532; T/R Systems U.S. Pat. No. 5,596,416 by Barry et al; Canon Corp. U.S. Pat. No. 4,579,446 by Fujimoto; Fuji Xerox U.S. Pat. No. 5,208,640; Xerox U.S. Pat. No. 6,125,248 by Rabin Moser on parallel path printing; and a "Xerox Disclosure Journal" publication of November-December 1991, Vol. 16, No. 6, pp. 381-383 by Paul F. Morgan entitled "Integration Of Black Only And Color Printers." Also, the above cross-referenced co-pending and commonly owned U.S. patent application Ser. No. 10/761,522 filed Jan. 21, 2004.

Various types of exemplary print media sheet feeders, such as those with retard sheet feeding nips and/or vacuum sheet feeding heads, and nudger wheels and/or pneumatic "air knife" or other sheet separation and sheet feeding assistance systems therefore, are well known in the art and need not be re-described herein. Some incorporated by reference examples of modern retard feeders include U.S. Pat. Nos. 6,182,961 issued Feb. 6, 2001 to Stephen J. Wenthe Jr. (Xerox Corp.) on an active retard roll sheet separator/feeder, along with numerous other prior retard and other feeder patents cited therein. Some incorporated by reference examples of a modern type of more costly and complex high speed sheet feeder with, variously, skirted vacuum sheet corrugating sheet acquisition heads with air knives or puffers assistance and a shuttle movement of the feed head, include one or more of Xerox Corp. U.S. Pat. Nos. 6,398,207; 6,398,208; 6,352,255; 6,398,207; and 6,264,188, and other patents cited therein.

A specific feature of the specific embodiments disclosed herein is to provide a print media sheet feeding method for feeding print media sheets having opposing faces from the same single stack of print media sheets in the same sheet stacking tray into at least two different first and second sheet feeding paths of a printing system, in which said print media sheets are alternately sequentially individually fed in opposing directions from opposing sides of the same stack of print media sheets by first and second separate sheet feeders separately positioned adjacent to respective said opposing sides of said same stack of print media sheets, said first sheet feeder feeding said print media sheets into said first sheet feeding path starting at one side of said stack of print media sheets and said second sheet feeder feeding said print media sheets into said second sheet feeding path starting at said opposing side of said stack of print media sheets, wherein at least one of said first and second sheet feeders is repositionable towards and away from the other said sheet feeder to accommodate feeding of different size stacks of different sizes of said print media sheets from said same sheet stacking tray from said opposing sides of said stack, and wherein at least one of said first and second sheet feeding paths is partially repositionable in length in coordination with said repositioning of said at least one of said first and second sheet feeders.

Further specific features disclosed in the embodiments herein, individually or in combination, include those wherein said sheet stacking tray has at least one repositionable stack edge guide repositionable to accommodate said feeding of different sizes of print media sheets being stacked therein, and said at least one repositionable sheet feeder is automatically repositioned with said repositioning of said repositionable stack edge guide; and/or wherein said printing system comprises at least first and second printing engines, and said first sheet feeding path feeds said print media sheets therein to said first printing engine and said second sheet feeding path feeds said print media sheets therein to said second printing engine without being printed in said first printing engine; and/or wherein said print media sheets from said second sheet feeding path are inverted in said second sheet feeding path and merged with said print media sheets from said first sheet feeding path print into a merged sheet path to provide the same orientation in said merged sheet path of said faces of said print media sheets from both said first and second sheet feeding paths; and/or wherein said print media sheets from said second sheet feeding path are inverted in said second sheet feeding path and merged with said print media sheets from said first sheet feeding path print into a merged sheet path to provide the same orientation in said merged sheet path of said faces of said print media sheets from both said first and second sheet feeding paths, all of which is provided in a sheet feeding modular unit, and said printing system comprises at least first and second printing engines which are fed said print media sheets from said merged sheet path of said sheet feeding modular unit at substantially twice the individual sheet feeding rate of said first and second sheet feeders; and/or in which said stack of print media sheets and said first sheet feeding path is mounted inside of said first print engine and said second sheet feeding path feeds said print media sheets into a sheet bypass path from said first printing engine to said second printing engine; and/or in which said printing system comprises first and second printing engines with similar first and second printing rates, and said first sheet feeder feeds said print media sheets into said first sheet feeding path to said first printing engine at said first printing rate and said second sheet feeder feeds said print media sheets into said second sheet feeding path to said second printing engine at said second printing rate; and/or a print media sheets feeding system for a printing system with a sheet stacking tray and first and second separate sheet feeders and at least two different first and second sheet feeding paths, for feeding print media sheets having opposing faces from the same single stack of print media sheets in said sheet stacking tray into said at least two different first and second sheet feeding paths of said printing system, in which said print media sheets are alternately sequentially individually fed in opposing directions from opposing sides of said same stack of print media sheets in said sheet stacking tray by said first and second sheet feeders, and said first and second sheet feeders are positioned adjacent to respective said opposing sides of said same stack of print media sheets, with said first sheet feeder feeding said print media sheets into said first sheet feeding path starting at one side of said stack of print media sheets and said second sheet feeder feeding said print media sheets into said second sheet feeding path starting at said opposing side of said stack of print media sheets, wherein at least one of said first and second sheet feeders is repositionable towards and away from the other said sheet feeder to accommodate the feeding of different size stacks of different sizes of said print media sheets from said same sheet stacking tray from said opposing sides of said stack, and wherein at least one of said first and second sheet feeding paths is partially repositionable in length in coordination with said repositioning of said at least one of said first and second sheet feeders; and/or wherein said sheet stacking tray has at least one repositionable stack edge guide repositionable to accommodate said different sizes of print media sheets being stacked therein, and said second sheet feeder is mounted to and automatically repositioned with said repositioning of said repositionable stack edge guide, and said second sheet feeding path includes a overlying stationary sheet transport path and a repositionable arcuate sheet inverting sheet path between said second sheet feeder and said overlying stationary sheet transport path; and/or wherein said sheet stacking tray has at least one repositionable stack edge guide repositionable to accommodate said feeding of different sizes of print media sheets being stacked therein, and said at least one repositionable sheet feeder is automatically repositioned with said repositioning of said repositionable stack edge guide; and/or in which said first and second sheet feeders include respective first and second sheet nudgers adjacent opposite sides of said stack for engaging the uppermost print media sheet of said stack; and wherein said second sheet feeder is automatically actuated after said uppermost sheet of said stack has been pulled out from under said second sheet nudger by said first sheet feeder; and/or in which said first and second sheet feeders include respective first and second sheet feed nips, and respective first and second sheet nudger systems engaging and disengaging the uppermost sheet of said stack; and said first sheet nudger system of said first sheet feeder is automatically disengaged from said uppermost sheet of said stack when said second sheet feeding nip of said second sheet feeder is feeding a sheet and said second sheet nudger system of said second sheet feeder is automatically disengaged from said uppermost sheet of said stack when said first sheet feeding nip of said second sheet feeder is feeding a sheet; and/or in which said second sheet feeding path includes an overlying sheet transport path extending over said stack and a repositionable sheet transport path repositionable with at least one of said first and second sheet feeders and extending from said at least one of said first and second sheet feeders to said overlying sheet transport path for feeding said print media sheets to variable positions on said overlying sheet transport path depending on said repositioning of said at least one of said first and second sheet feeders; and/or wherein said first and second sheet feeders are retard type sheet separator-feeders with sheet retarding members driven in a reverse direction to the sheet feeding direction of said first and second sheet feeders, and said first and second sheet feeders; and/or wherein said first and second sheet feeders also have active sheet nudgers extending partially over the upper surface of said stack; and/or wherein said first and second sheet feeders are active retard type sheet separator-feeders with respective sheet retarding nips that are automatically alternately opened to allow a sheet in said sheet retarding nip of first sheet feeder to be pulled out of said sheet retarding nip by said second sheet feeder, and vice versa; and/or in which said second sheet feeding path includes a stationary elongated sheet transport path and a repositionable arcuate sheet transport path repositionable together with said at least one of said first and second sheet feeders and extending from said at least one of said first and second sheet feeders to said stationary elongated sheet transport path at variable positions on said overlying sheet transport path depending on said repositioning of said at least one of said first and second sheet feeders; and/or in which said stationary elongated sheet transport path has multiple different sheet entry positions baffling; and/or in which said stationary elongated sheet transport path has a variable length retractable baffle; and/or in which said stationary elongated sheet transport path has an elongated transport belt and multiple variable position idler rollers engaging said transport belt; and/or wherein said first and second sheet feeders have active sheet nudgers partially overlying and intermittently engaging the upper surface of said stack in said sheet stacking tray, and wherein said first and second sheet feeders are active retard type sheet separator-feeders having respective sheet retarding nips that are automatically alternately opened to allow a sheet in said sheet retarding nip of one said sheet feeder to be pulled out of said sheet retarding nip thereof by the other said sheet feeder, and wherein said respective sheet retarding nips of both of said first and second sheet feeders do not overly said upper surface of said stack in said sheet stacking tray.

The disclosed systems may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate or print media for images, whether precut or initially web fed. A "copy sheet" may be abbreviated as a "copy" or called a "hardcopy." Print media sheet separator/feeders are commonly, and herein, referred to just as sheet feeders. A "print job" is normally a set of related sheets, usually one or more collated copy sets copied from a set of original document sheets or electronic document page images, from a particular user, or otherwise related. A "simplex" document or copy sheet is one having its image and any page number on only one side or face of the sheet, whereas a "duplex" document or copy sheet has "pages," and normally images, on both sides, that is, each duplex sheet is considered to have two opposing sides or "pages" even though no physical page number may be present.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, the disclosed systems and methods will be better understood from this description of these specific embodiments, including the drawing figures (which are approximately to scale) wherein:

FIG. 1 schematically shows a front view [with covers removed] of one example of a sheet feeding module for a printing system, with examples of a dual sheet feeding system for feeding sheets from opposite sides of variable size stacks of plural sheet trays, with schematic representations one type of low cost retard roller type sheet feeder, such as those incorporated by reference above, repositionable with a normal repositionable tray side guide, and with examples of sheet inversion paths for sheets fed from one side of the stacks.

Figure 1:
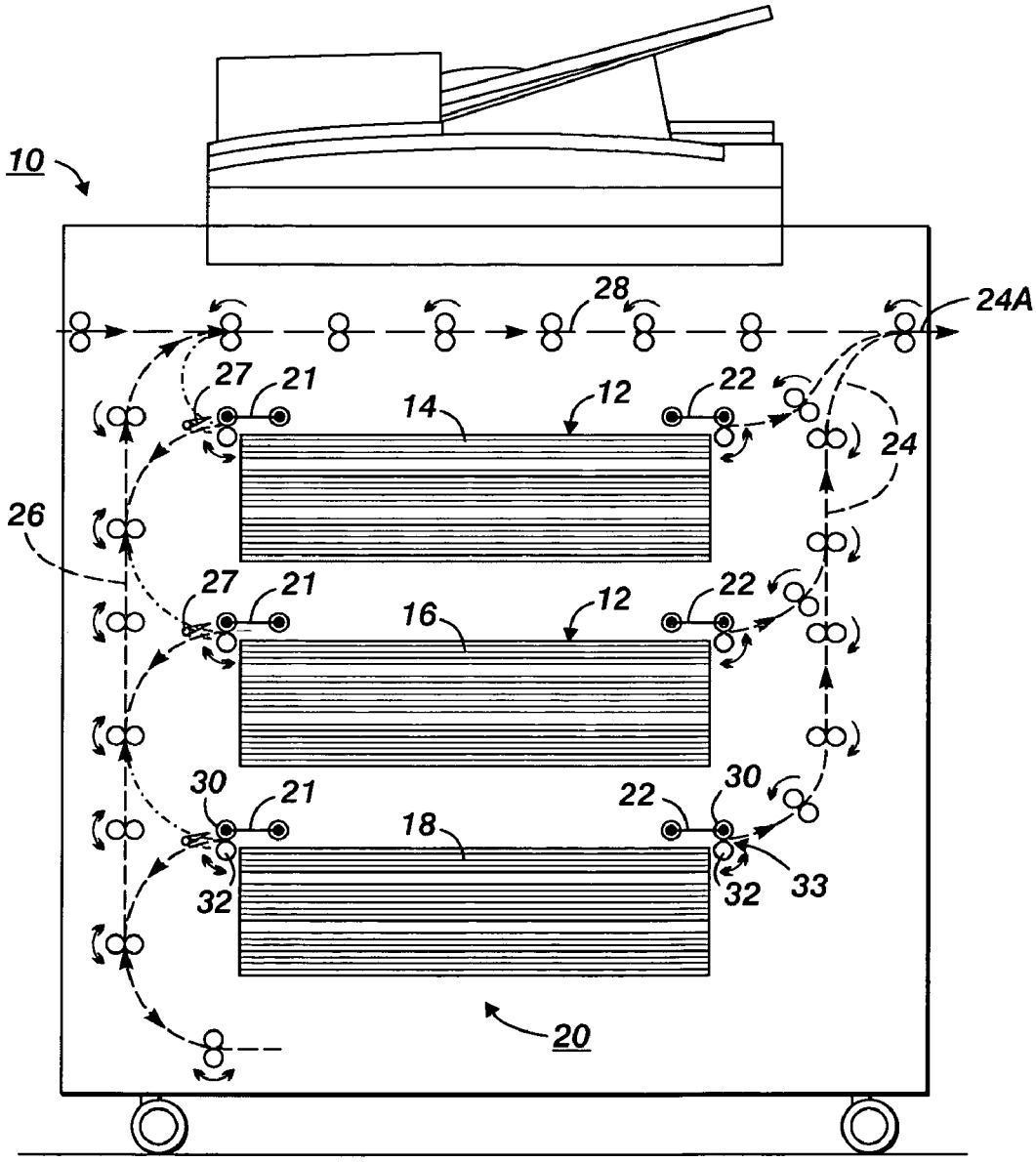
Figure 2:
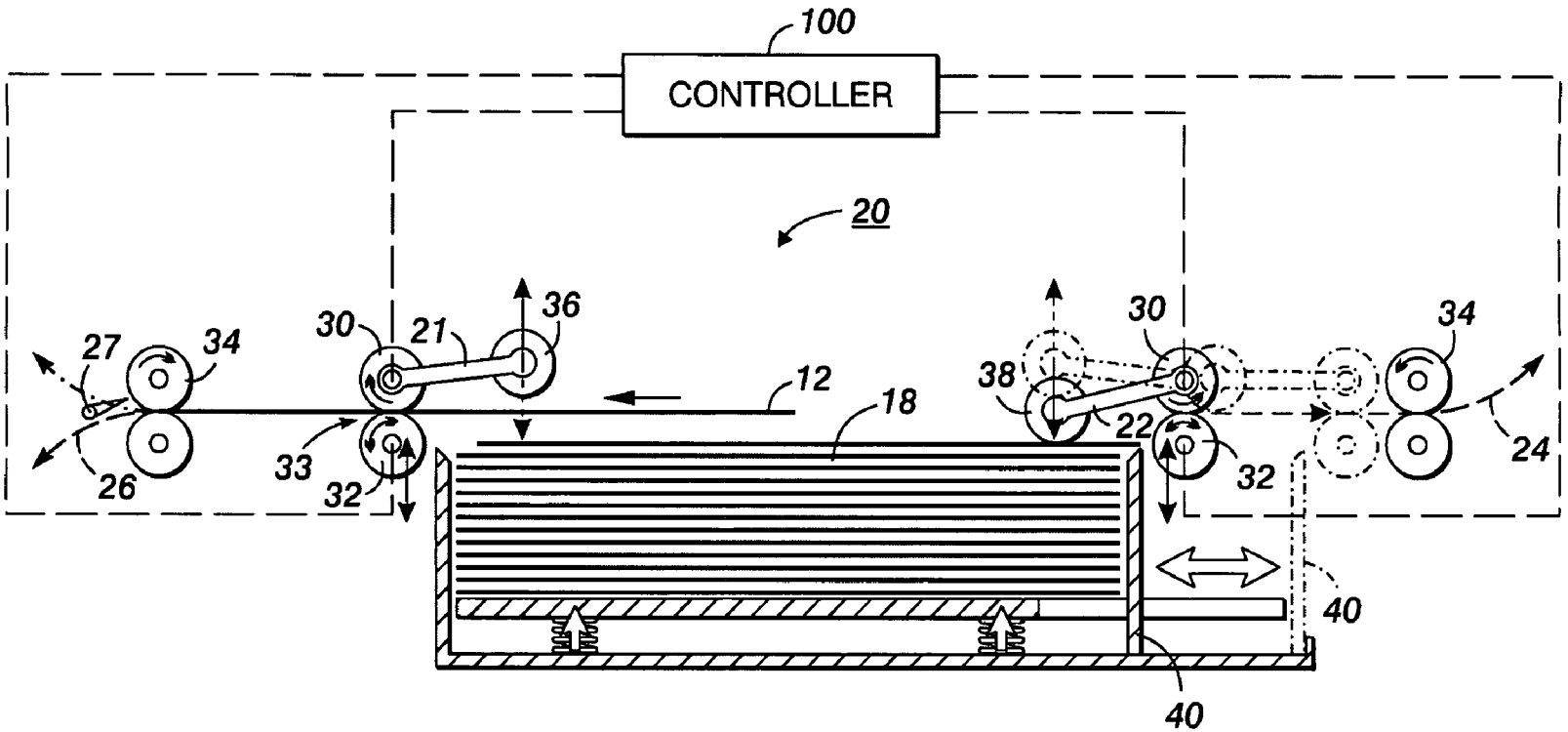
FIG. 2 is an enlarged schematic view of one tray and its dual feeders of the example of FIG. 1, showing the feeding of a previously separated top sheet from the left side sheet feeder's retard roller nip to its downstream take-away rollers (TAR) simultaneously with the next top sheet starting to being separated from the same stack by the right side sheet feeder's lowered active nudger.
Figure 3:
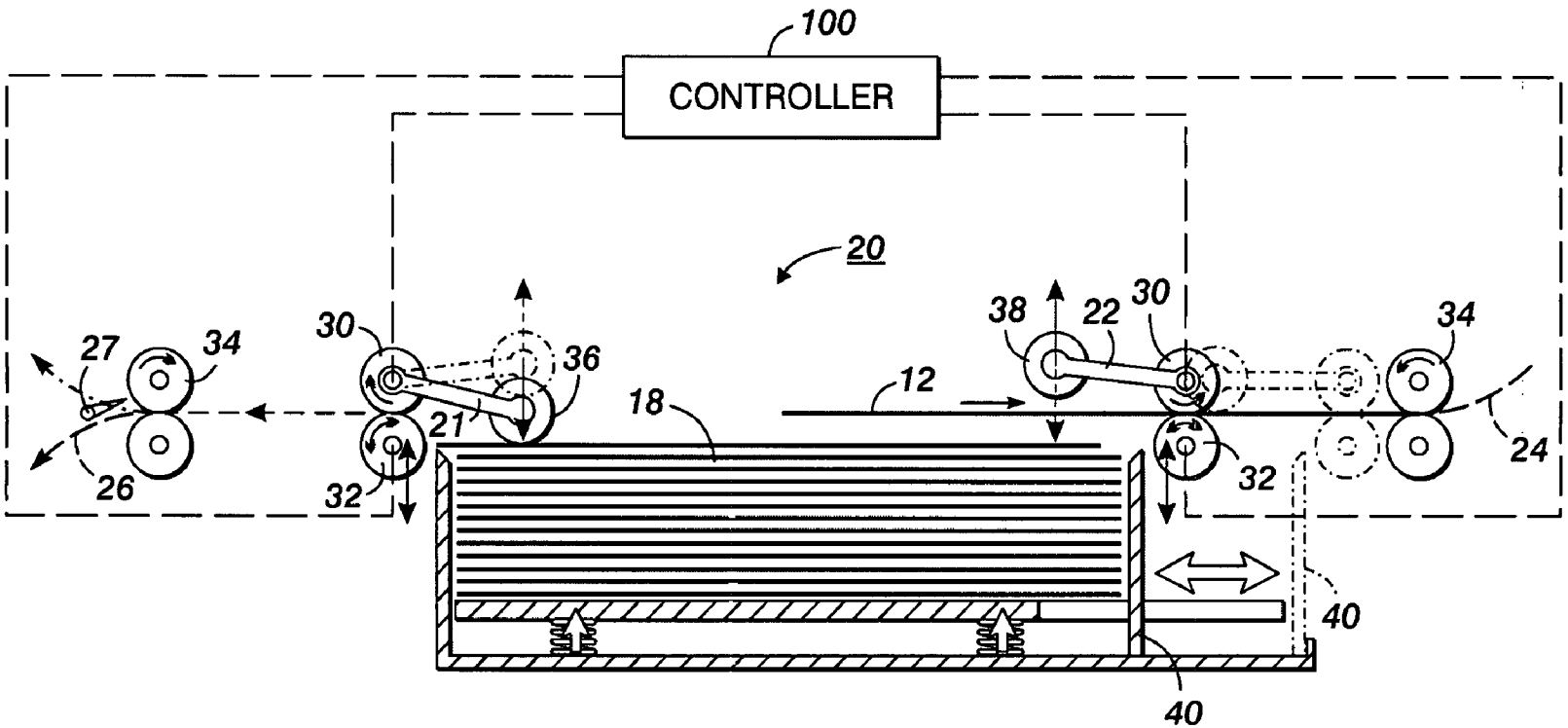
FIG. 3 is the same as FIG. 2, showing the similar but alternate (and alternate side) feeding of the next top sheet by the right side sheet feeder.
Figure 5:
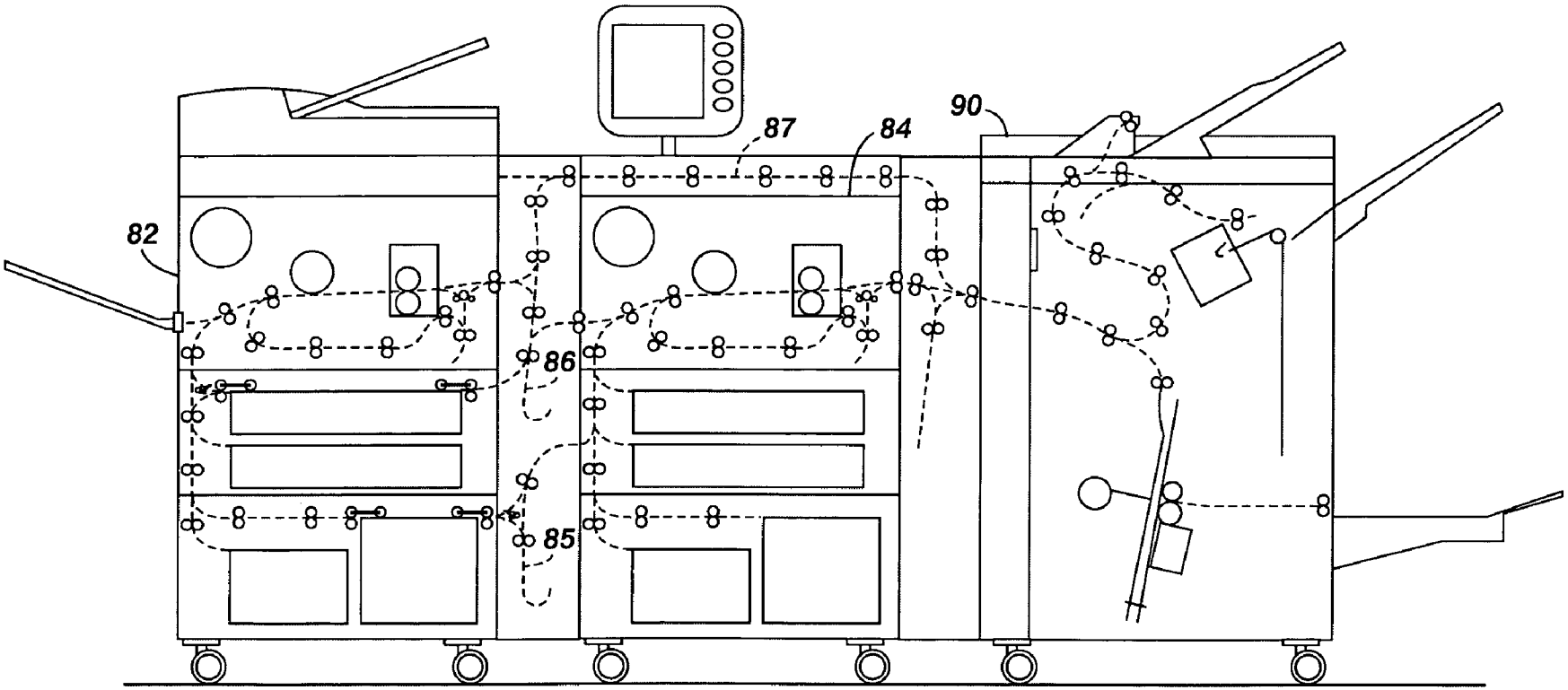
FIG. 5 PRIOR ART
Figure 6:
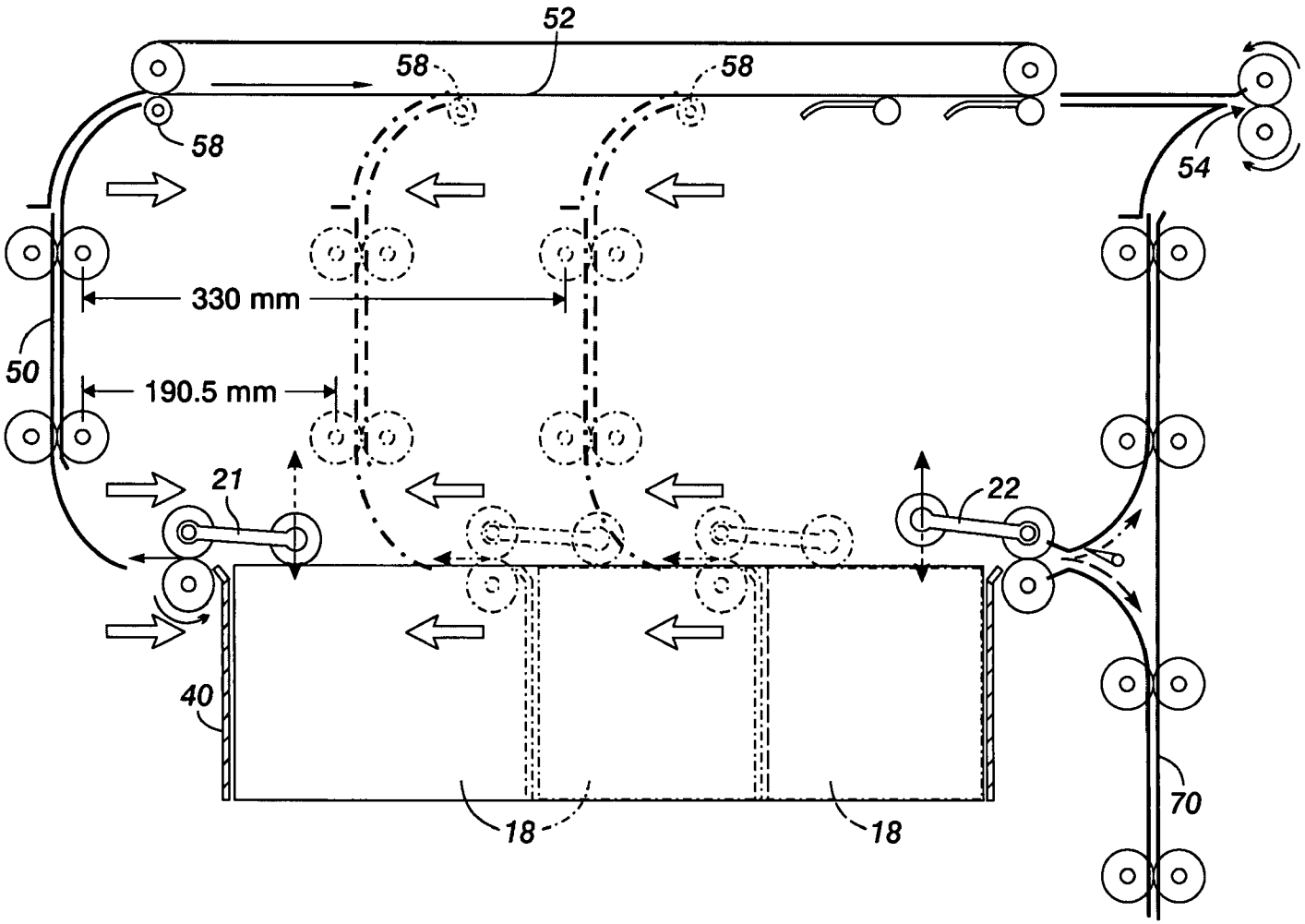
Figure 7:
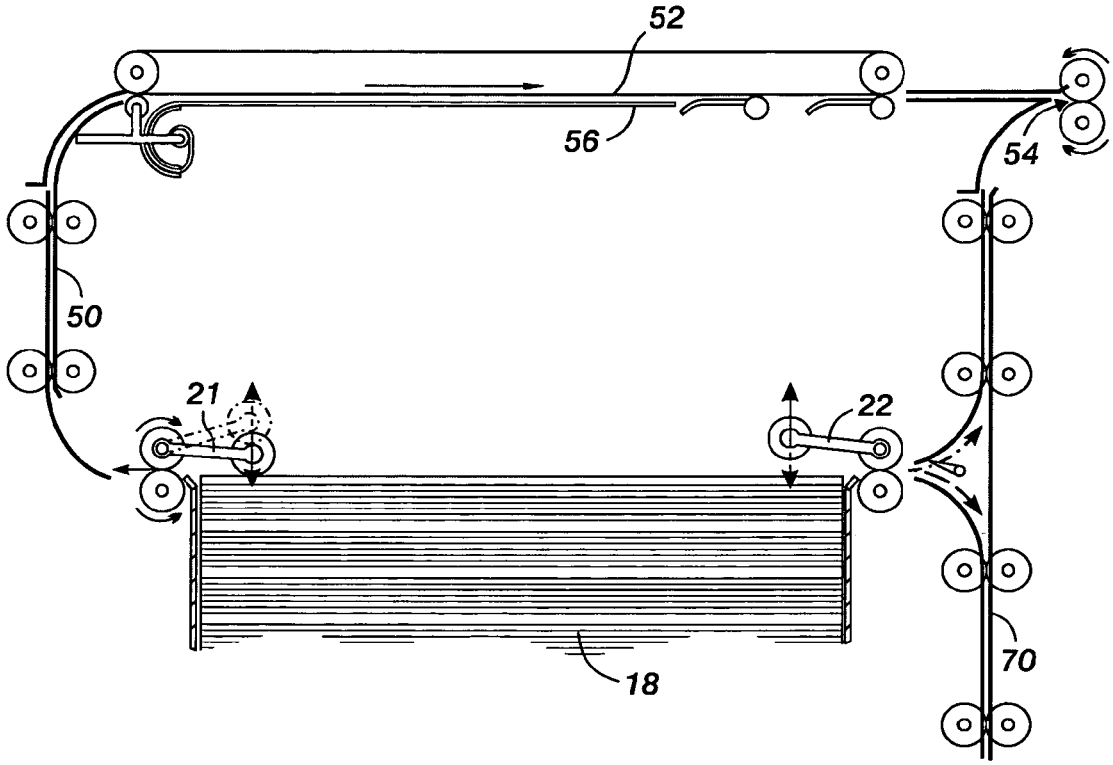
Figure 8:
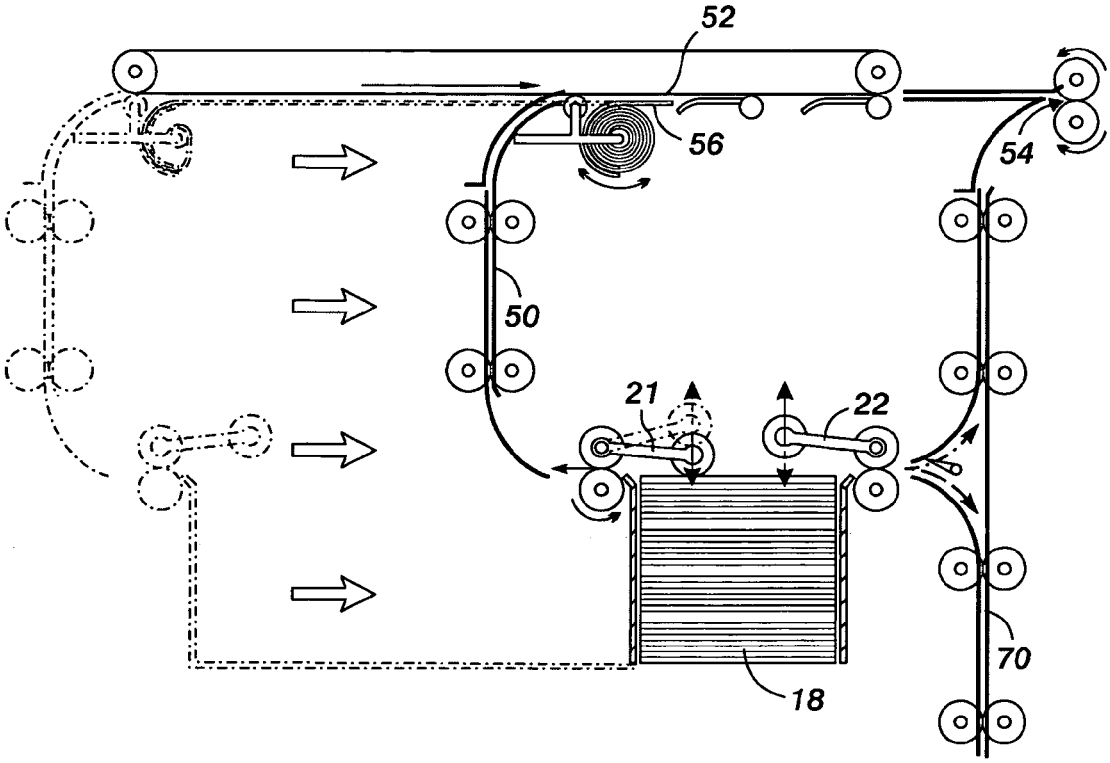
Figure 9:
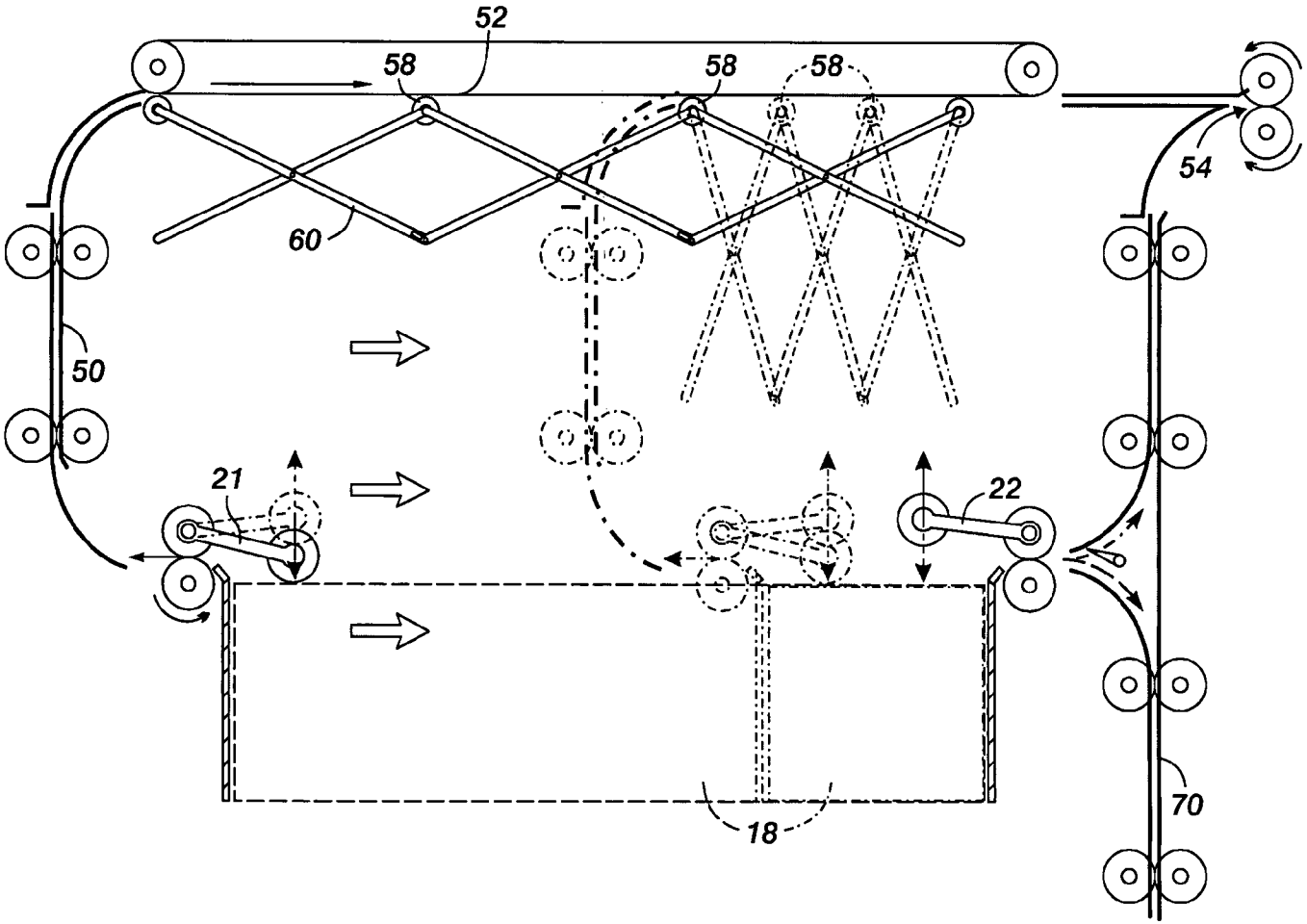
Figure 10:
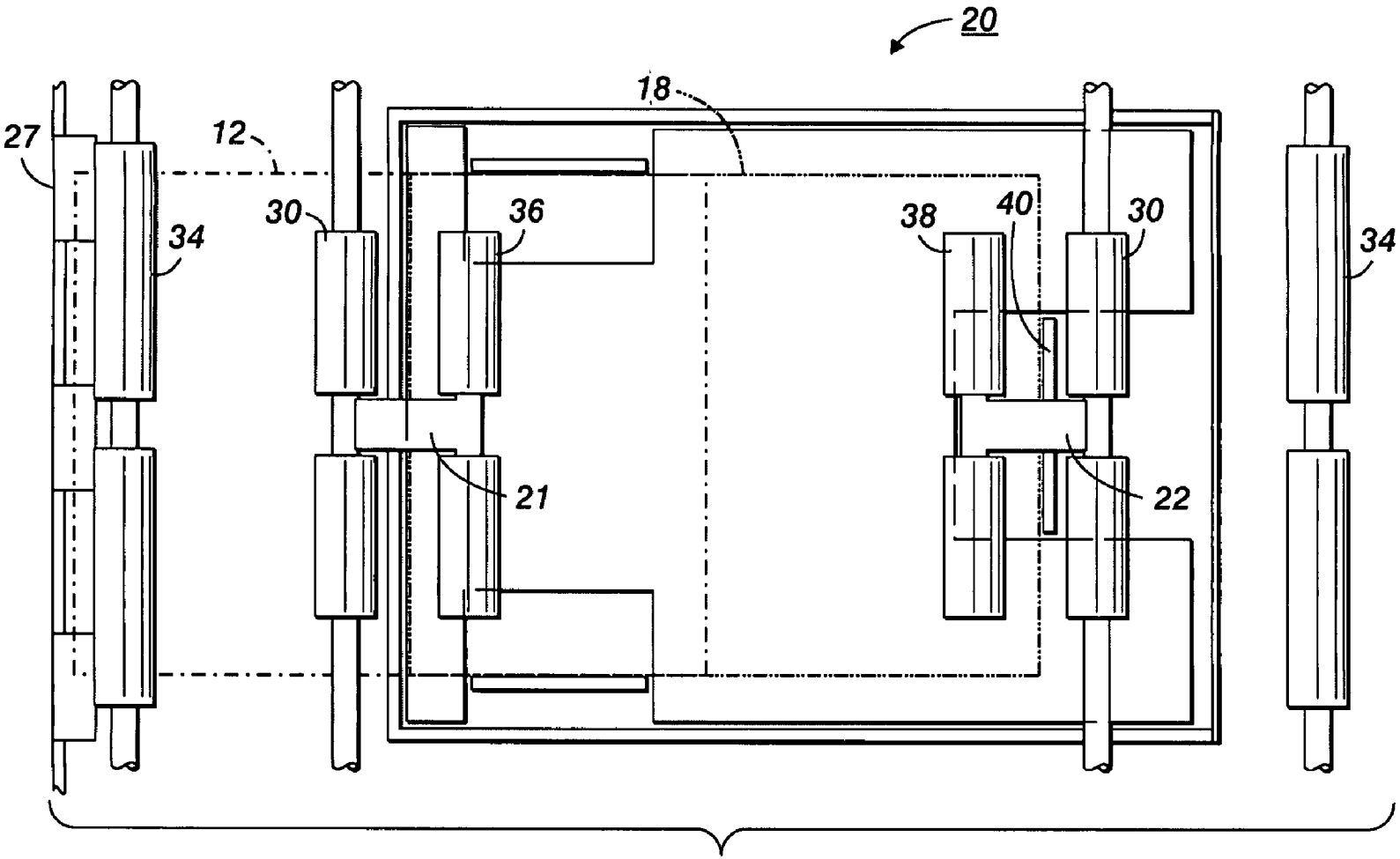

FIG. 5, is one example of an integrated dual print engines printing system such as those discussed and incorporated by reference above, with further examples akin to FIGS. 1, 2 and 3 of a dual sheet feeding system for feeding sheets from opposite sides of the stacks of plural sheet trays inside the first of two print engines (with optional sheet input from the module of FIG. 1) and different optional sheet inverters and sheet paths before (between) and over the second print engine, and a modular finisher unit for both;

FIG. 6 is an alternative embodiment of the dual sheet feeder concept illustrating another example of a system for automatically repositioning one of the opposing sheet feeders (on the left in this view) with the repositioning of a stack side guide for feeding different sizes of sheets loaded into the tray, and additionally showing an associated commonly repositionable arcuate sheet path baffle for feeding sheets from the repositionable sheet feeder to different reposition positions along an overlying elongated fixed sheet transport belt system with multiple fixed nips;

FIG. 7 is a variation of the embodiment of FIG. 6 in which the overlying elongated fixed sheet transport belt system has an opposing variable length baffle provided by an extendible/retractable window shade, shown here in its fully extended position for feeding the largest dimension sheets from both sides of the stack thereof;

FIG. 8 shows the system of FIG. 7 in its fully retracted baffle position for feeding the smallest dimension sheets from both sides of the stack thereof;

FIG. 9 is another variation of the embodiment of FIGS. 6, 7 and 8 in which as shown by the difference between their solid and phantom line positions, a multiple scissors linkage connected to idlers engaging the elongated fixed transport belt automatically repositions those idlers when the left side sheet feeder is repositioned by the left side tray guide being repositioned for the stacking of different size sheets therein; and FIG. 10 is a top view of the elevator type paper tray shown in FIGS. 2 and 3 illustrating an exemplary tray cut-out to allow the repositioning of one side guide.

Describing now in further detail these exemplary embodiments with reference to their Figures, adding further to their descriptions, in FIG. 1 there is shown a sheet feeding module 10 for feeding print media sheets 12, from stacks 14, 16 or 18, at a desired rate to a single or plural (as in FIG. 5) print engine printing system. Disclosed is an exemplary dual sheet feeding system 20 with sheet feeders 21 and 22 alternately feed sheets from opposite sides of the sheet stacks 14, 16 or 18, as selected. These sheet feeders are retard type sheet feeders such as those cited and incorporated by reference above. In this particular module 10 example, sheets fed from the right side of the stacks by the right side feeders 22 feed into a common output path 24 without inversion (without being turned over). In contrast, sheets fed from the left side of the stacks 14, 16 or 18 by the left side feeders 21 first are fed into a left side output path 26 having reversible (as shown) sheet path feed rollers and optional downward paths selectable by pivotal gates 27 or otherwise providing optional sheet inversion of the sheets 12 fed from the left side of the stacks. Then the left side output path 26 merges (via a common overhead bypass path 28 in this example) with the downstream output end 24A of the right-side common output path 24. However, contrast this to the quite different alternative invert or non-invert sheet paths of FIG. 5.

Both the left side and right side stack feeders 21, 22, as better shown in FIGS. 2 and 3, may be identical, and mounted in mirror image orientations. In this example, both feeders 21 and 22 may have a conventional low cost retard roller 32 and mating drive roll 30 adjacent their respective opposing stack edges forming a sheet separating retard nip 33 for feeding separated sheets 12 on to downstream take-away rollers (TAR) 34. As is well known, the retard roller 32 may be designed to rotate with the drive roller when they are in direct engagement, but may be rotatably driven in the opposite direction when more than one sheet is in the retard nip to push back the underlying sheet(s). In this example, another option is to automatically alternately open the retard nip of one sheet feeder to allow a sheet in that sheet retarding nip of that sheet feeder to be pulled back out of its sheet retarding nip by the other sheet feeder when it is feeding out a sheet, and vice versa.

In this dual sheet feeding system 20, the sheet feeders 21, 22 also have otherwise conventional respective active nudger wheels 36 and 38 extending out over one respective end area of their respective stack, such as the FIG. 1 bottom stack 18 shown individually in FIGS. 2 and 3. That is, these nudgers 36, 38 are positioned overlying the top of the stack although extending out over only a minor portion of the total stack width. As shown by their associated movement arrows in FIG. 2 relative to FIG. 3, the two opposite nudgers 36, 38 of the two opposite sheet feeders 21, 22 alternately lift so that they will not both drivingly engage the same top sheet at the same time.

However, once the downstream end area of a top sheet has been pulled out from under a nudger by being partially fed by the opposing sheet feeder, that nudger can be lowered onto the now-exposed end of the next sheet to start its feeding in the opposite direction by its sheet feeder. That is, it is not necessary for one sheet feeder to feed a top sheet fully (or even the majority thereof) off of the top of the stack from one side before starting to feed the next underlying sheet in the opposite direction with the nudger on the opposite side of the stack. The second sheet feeding can be started as soon as the first sheet is conventionally sensed by a conventional optical sheet lead edge paper path sensor to have passed through the retard nip of the first feeder. Alternatively, the start of acquisition of the next or second sheet by the other sheet feeder can be delayed until the first sheet is in the closely downstream take away rollers (TAR) nip of the first sheet feeder. These actuations may all be conventionally controlled, as by a conventional controller 100.

In summary, both the first and second sheet feeders in the example of FIGS. 1-3 and 7-9 have active (driven) and liftable sheet nudgers partially overlying and intermittently engaging the upper surface of the stack in the same sheet stacking tray. Both the first and second sheet feeders in this example are active retard type sheet separator-feeders having respective sheet retarding nips with rationally spring loaded or otherwise reverse driven retard rollers, and these retard nips may also be optionally automatically alternately opened to allow a sheet in the sheet retarding nip of one sheet feeder to be pulled out of that sheet retarding nip by the other (opposite) sheet feeder. The sheet retarding nips of both sheet feeders do not overly the upper surface of said stack in the sheet stacking tray—only their nudgers do.

Figure 4:
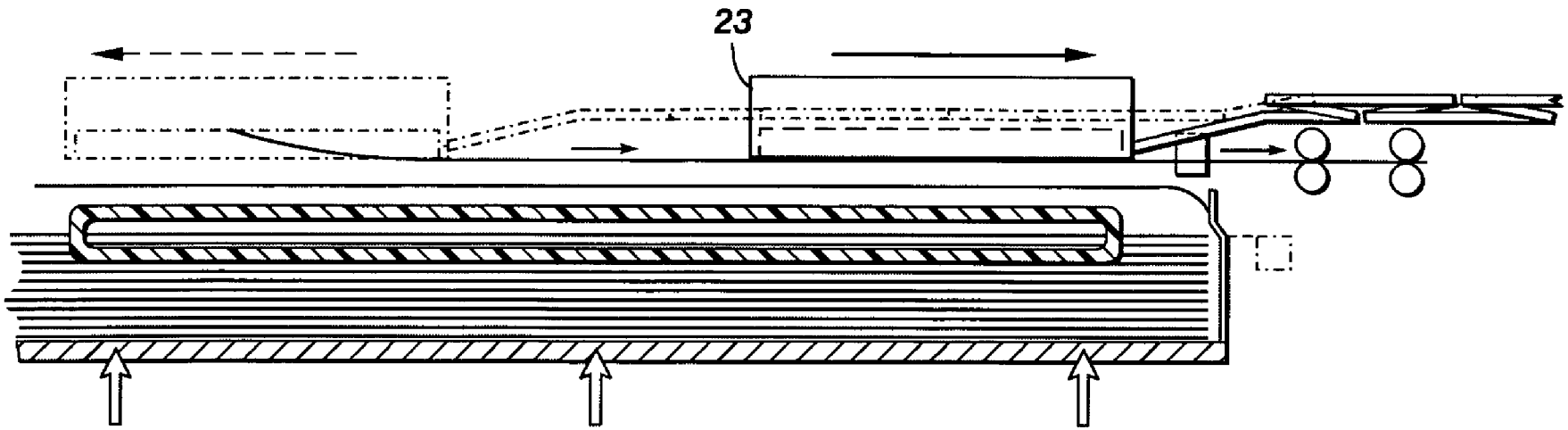
FIG. 4 PRIOR ART
FIG. 4 is similar to FIGS. 2 and 3 but a partial view of only one side of an elevator tray and its sheet stack, schematically illustrating a different type of sheet feeder, in this case known vacuum corrugating shuttle feeder with lateral stack air puffing (its manifold appears in cross-section in this view) such as those cited and incorporated by reference above.

FIG. 4 is a partial view of only one side of a single elevator tray and its sheet stack, schematically illustrating one example of a different type of sheet feeder. In this example a known vacuum corrugating shuttle feeder 23 with lateral stack air puffing assistance (the manifold for that appears in cross-section in this view) such as those cited and incorporated by reference above.

As illustrated, particularly by the differences between FIGS. 7 and 8 or the difference between the solid and phantom line positions in FIGS. 6 and 9, the sheet stacking tray has at least one otherwise conventional repositionable stack edge guide 40 repositionable to accommodate the stacking therein and feeding of different sizes of print media sheets. At least one of the two sheet feeders may be mounted to its adjacent stack edge guide 40 to be automatically repositioned therewith, as shown. I.e., desirably automatically repositioned with the repositioning of said repositionable stack edge guide to the new size of the new sheets being loaded to be fed. When the edge guide is conventionally reset to the size of the paper to be fed, both sheet feeders are thus automatically reset to their above-described desired positions relative to the sheet stack and relative to one anther. If desired this combined movement can also be partially motorized to automatically open to the maximum width for ease of access when the system is shut down or almost all the paper has been fed from the tray. If desired, the repositionable sheet feeder can automatically disconnect from its operatively connecting side guide when the sheet tray is pulled out or its access door opened.

As shown in the examples of FIGS. 6-9, the repositionable sheet feeder (here the left side sheet feeder 21) feeds sheets into a second sheet feeding path, starting from that sheet feeder 21, feeding them first into a connecting, repositionable therewith, arcuate sheet inverting path 50 extending between that sheet feeder 21 and an overlying, fixed, elongated, stationary sheet transport belt path 52. The sheets engage and are captured by the transport path 52 at variable positions along transport path 52, depending on the positioning of the repositionable sheet feeder 21 and its repositionable sheet inverting path 50. In the embodiment of FIG. 6 this is provided by multiple spaced arcuate baffling 54 providing multiple sheet entry points to the facing path 50. In the embodiment of FIGS. 7 and 8, the baffle providing the opposite side of the sheet path 50 from its moving belt is instead provided by a variable length retractable baffle 56, which may be somewhat like a roll-up window shade. In the embodiment of FIG. 9 the normal force holding the sheets against the moving transport belt of the path 50 is provided by multiple variable position idler rollers 58 engaging said transport belt, each of which may be mounted on the upper ends of a multiple retractable-expandable parallelogram or scissors type linkage 60, which may be automatically repositioned with the repositionable arcuate sheet inverting path 50. An optional sheet inverter path 70 may be provided for the sheet output of the other, fixed position, sheet feeder 22, as shown for these embodiments, to invert sheets prior to the common output 54, thus providing the same number of sheet inversions and the same sheet face orientation from both sheet feeders, or not, selectably. In these figures, for clarity only, renositionable sheet feeder 21 is shown; however, as indicated throughout this disclosure sheet feeders 21 and 22 are both substantially identically repositionable (para.[035]) as indicated in paragraphs [0018] and [0019]. Thus, the figures show a typical repositionable sheet feeder 21; however, it is to be understood sheet feeder 22 acts as sheet feeder 21 shown for clarity in the figures.

The different illustrated repositioning positions of the repositionable elements of the embodiments in FIGS. 6-9 show how they can provide for expansion or contraction of approximately 330 mm to accommodate dual feeding of a wide range of standard print media sheet sizes from the same tray stack 18 of from A5 to A3 sizes, yet transport such print media sequentially to a common merged sheet exit, as shown, or separate exits for separate print engines, or for duplexing.

As noted, FIG. 5 is one example of an integrated dual print engines 82, 84 printing system such as those discussed and incorporated by reference above, with further examples akin to FIGS. 1, 2 and 3 of a dual sheet feeding system for feeding sheets from opposite sides of the stacks of plural sheet trays inside the first of the two print engines and different optional sheet inverters 85, 86 and sheet paths before (between) and over (87) the second print engine, and a modular finisher unit 90 for both.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A print sheet feeding module and a printing system comprising:

at least one stacking tray;

two sheet feeders each positioned at opposite sides of said tray that will direct sheets contained in said tray into different sheet feeding paths;

said sheet feeders are each repositionable towards and away from each other to thereby feed different size sheets;

said module and system providing for one print application an alternately sequentially feeding of the sheets to said sheet feeding paths in opposing directions from opposite sides of said tray;

said different sheet feeding paths adapted to be directed and merged to a common bypass path for feeding to at least one print engine, said different sheet feeding paths merge the sheets in a same orientation in said bypass path before feeding to the at least one print engine;

said sheet feeders comprising a nudger wheel and a retard roller with a mating drive roll to form a sheet retard nip for feeding said sheets to downstream take away rollers;

at least one of said sheet feeders is mounted to a stray stack edge guide such that said at least one sheet feeder is coordinated with a resetting of the positions of said tray stack edge guide when different size sheets are loaded into said tray;

feeding of a next or second sheet by a first one of said sheet feeders is delayed until a first sheet fed from a second one of said sheet feeders is in a downstream sheet path feed rollers;

said sheet feeders comprising said retard roller and said mating drive roller on an end of said sheet feeders and on an opposite end of said drive roller are active liftable nudger wheels extending out over one end area of said stack;

said nudger wheels of said sheet feeders alternately lift so that they will not both drivingly engage the same top sheet of said sheets at the same time; said liftable nudger wheels extend over one respective end of said stack; said nudger wheels lower onto an exposed portion of the next sheet in said stack to partially feed the next sheet to said retard roll and said drive roll;

said retard roll and said drive roll do not overlay said end of said upper surface of said stack;

said sheet feeders operatively connected to a controller that controls a start of feeding actuations of said sheet feeders including said nudger wheels.

2. The print media sheet feeding module of claim 1 comprising:

at least a first and a second printing engines and said first and second sheet feeding paths, said first sheet feeding path feeds said print media sheets therein to said first printing engine and said second sheet feeding path feeds said print media sheets to said second printing engine without being printed in said first printing engine.

3. The print media sheet feeding module of claim 1 comprising:

first and second printing engines with first and second printing rates, and said first sheet feeder feeds said print media sheets into said first sheet feeding path to said first printing engine at said first printing rate and said second sheet feeder feeds said print media sheets into said second sheet feeding path to said second printing engine at said second printing rate.

4. The print media sheets feeding module of claim 1 comprising:

a feeding system in which said first and second sheet feeders comprise respective first and second stack overlying sheet nudges adjacent opposite sides of said stack for engaging an uppermost print media sheet of said stack, and wherein said second sheet feeder is actuated after said uppermost sheet of said stack has been pulled out from under said second sheet nudger by said second sheet feeder.

5. The print media sheets feeding module of claim 1 comprising:

a feeding system in which said first and second sheet feeders comprise respective first and second said sheet feed nips, and respective first and second sheet nudgers engaging and overlying and disengaging an uppermost sheet of said stack;

said first sheet nudger of said first sheet feeder is disengaged from said uppermost sheet of said stack when said second sheet feeding nip of said second sheet feeder is feeding a sheet and said second sheet nudger of second sheet feeder is disengaged from said uppermost sheet of said stack when said first sheet feeding nip of said second sheet feeder is feeding a sheet.

* * * * *